US007104361B2

(12) United States Patent
Walsh

(10) Patent No.: US 7,104,361 B2
(45) Date of Patent: Sep. 12, 2006

(54) LADDER

(75) Inventor: Michael P. Walsh, Croydon (AU)

(73) Assignee: Branach Technology PTY Ltd., Croydon (AU)

( * ) Notice: Subject to any disclaimer, the term of this patent is extended or adjusted under 35 U.S.C. 154(b) by 252 days.

(21) Appl. No.: 10/683,119

(22) Filed: Oct. 14, 2003

(65) Prior Publication Data

US 2005/0056489 A1 Mar. 17, 2005

(30) Foreign Application Priority Data

Oct. 14, 2002 (AU) ..... 2002952064

(51) Int. Cl.
*E06C 1/00* (2006.01)
*E06C 7/16* (2006.01)

(52) U.S. Cl. ..... 182/156; 182/115; 248/238

(58) Field of Classification Search ..... 182/156, 182/152, 163, 115, 106, 129, 117–119, 123–126, 182/22–25; 248/210, 238
See application file for complete search history.

(56) References Cited

U.S. PATENT DOCUMENTS 652,948 A * 7/1900 Barth ..... 182/106
701,532 A * 6/1902 Bardin ..... 182/106
1,829,349 A * 10/1931 Frommeyer ..... 182/125
2,172,860 A * 9/1939 Weaver ..... 182/123
2,369,743 A * 2/1945 Langdon ..... 182/125
4,365,799 A * 12/1982 O'Brian et al. ..... 182/27
4,376,470 A * 3/1983 Ashton ..... 182/23
4,503,932 A * 3/1985 Hilton ..... 182/113
4,620,611 A * 11/1986 Good ..... 182/106
4,643,274 A * 2/1987 Tataseo ..... 182/106
4,648,481 A * 3/1987 Lee ..... 182/106
5,427,198 A 6/1995 Walsh
5,582,268 A * 12/1996 Heberlein ..... 182/113

FOREIGN PATENT DOCUMENTS

EP 0 055 940 7/1982

* cited by examiner

*Primary Examiner*—Hugh B. Thompson II
(74) *Attorney, Agent, or Firm*—Stites & Harbison PLLC; Ross F. Hunt, Jr.

(57) ABSTRACT

A platform ladder comprising two elongate ladder sections having feet at one end and an upper end, the upper end of each section being hinged to an upper rail, a platform pivotally secured to one ladder section below the upper end and adapted to interconnect with the other ladder section, and stays interconnecting each side of the ladder sections whereby when the ladder is in an operative position with the ladder sections assuming an erect A shaped profile with the platform extending between the ladder sections to define a standing platform, the ladder sections, upper rail and stays, define a four bar linkage.

7 Claims, 13 Drawing Sheets

LADDER

FIELD OF THE INVENTION

This invention relates to ladders and more particularly platform ladders.

BACKGROUND OF THE INVENTION

Worldwide statistics clearly shown that ladders are dangerous especially self supporting step ladders that provide a simple and economical means for gaining access to elevated objects.

The inherent danger in the use of ladders has led to many countries legislating to improve the safety of such equipment.

Platform ladders provide a standing platform that is positioned below the top of the ladder that allows the user to stand on the platform and use both hands to complete tasks. Whilst there are a number of sophisticated platform ladders that provide a high level of safety by the introduction of hand rails and safety rails they tend to be bulky structures that are not readily transportable. Tradesmen require a platform ladder that is readily transportable.

It is safety aspects of ladders of this kind that has brought about the present invention.

SUMMARY OF THE INVENTION

In accordance with a first aspect of the present invention there is provided a platform ladder comprising two elongate ladder sections having feet at one end and an upper end, the upper end of each section being hinged to an upper rail, a platform pivotally secured to one ladder section below the upper end and adapted to interconnect with the other ladder section, and stays interconnecting each side of the ladder sections whereby when the ladder is in an operative position with the ladder sections assuming an erect A shaped profile with the platform extending between the ladder sections to define a standing platform, the ladder sections, upper rail and stays, define a four bar linkage.

The ladder is preferably foldable for transportation whereby the frame sections rest one against the other. Preferably in the folded configuration the platform and upper safety rail folds within the plane defined by the ladder sections.

Preferably, the platform is coupled to the other ladder section by at least one platform stay whereby as the ladder sections are parted from the folded configuration the platform stay controls a lowering movement of the platform until it engages the other ladder section when the sections are fully parted to assume an operative position.

BRIEF DESCRIPTION OF THE DRAWINGS

Embodiments of the present invention will now be described by way of example only with reference to the accompanying drawings in which.

DESCRIPTION OF THE PREFERRED EMBODIMENTS

Figure 1:
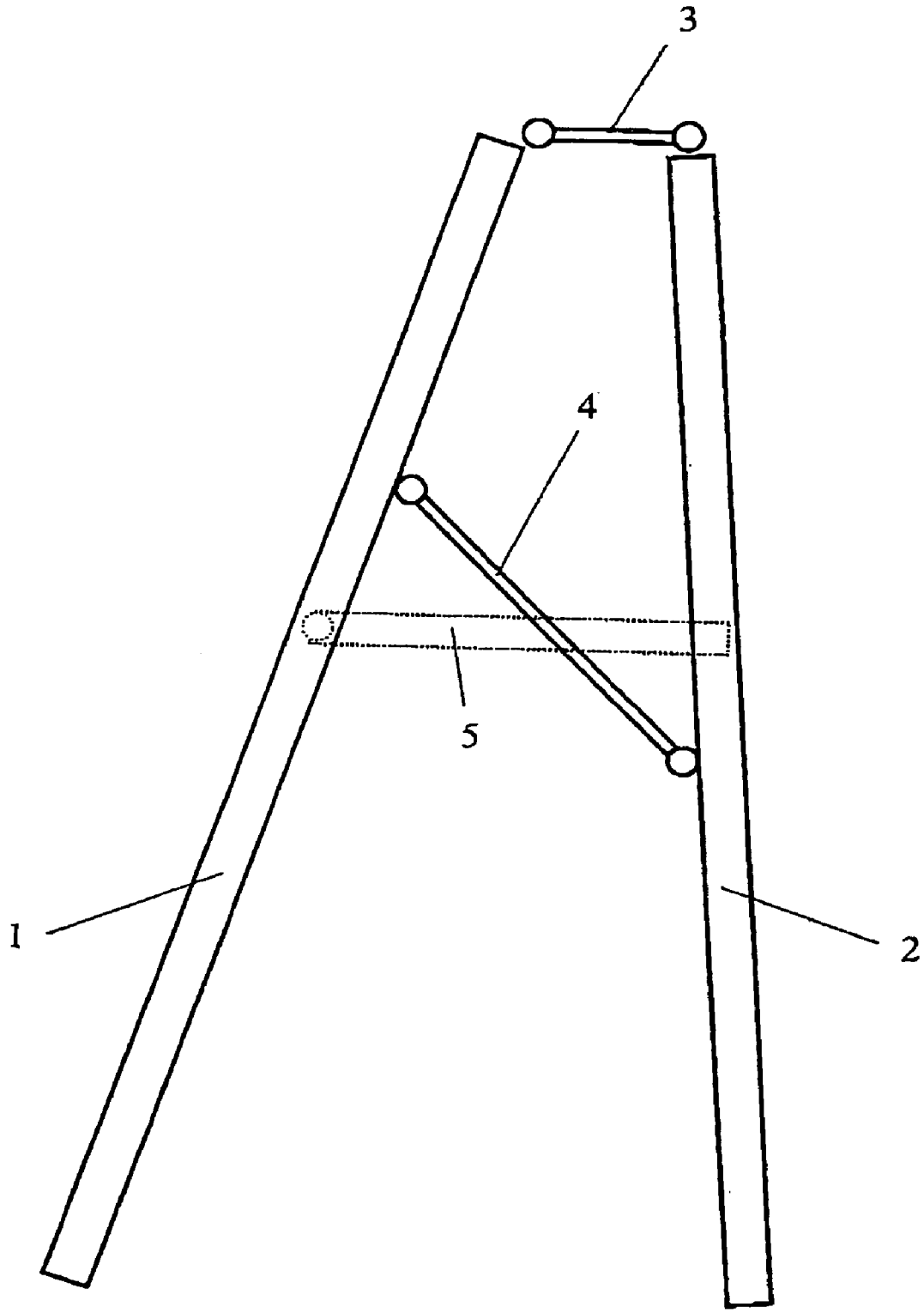
FIGS. 1 and 2 are schematic side elevational views of a platform ladder in an erect configuration.
Figure 2:
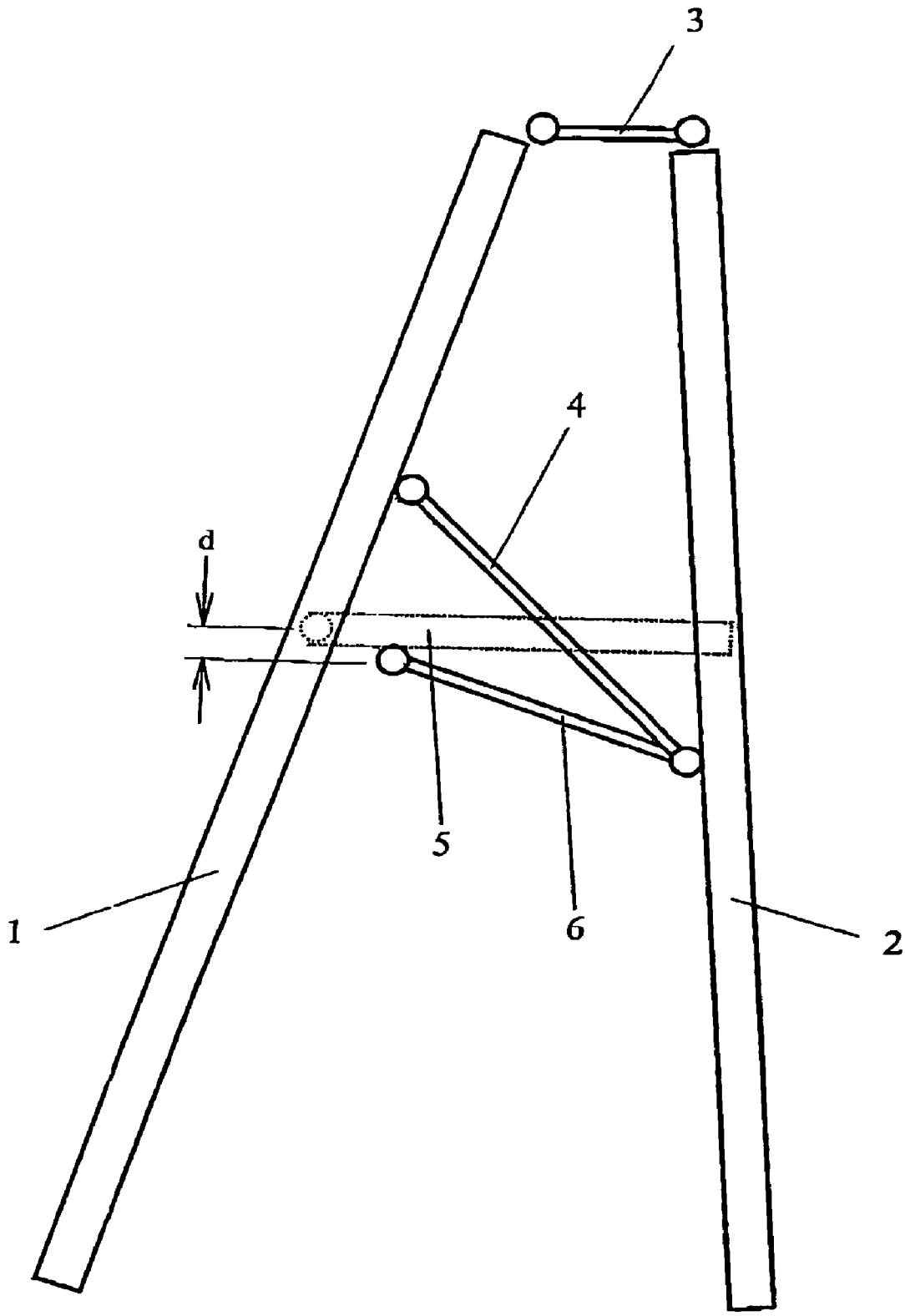
Figure 3:
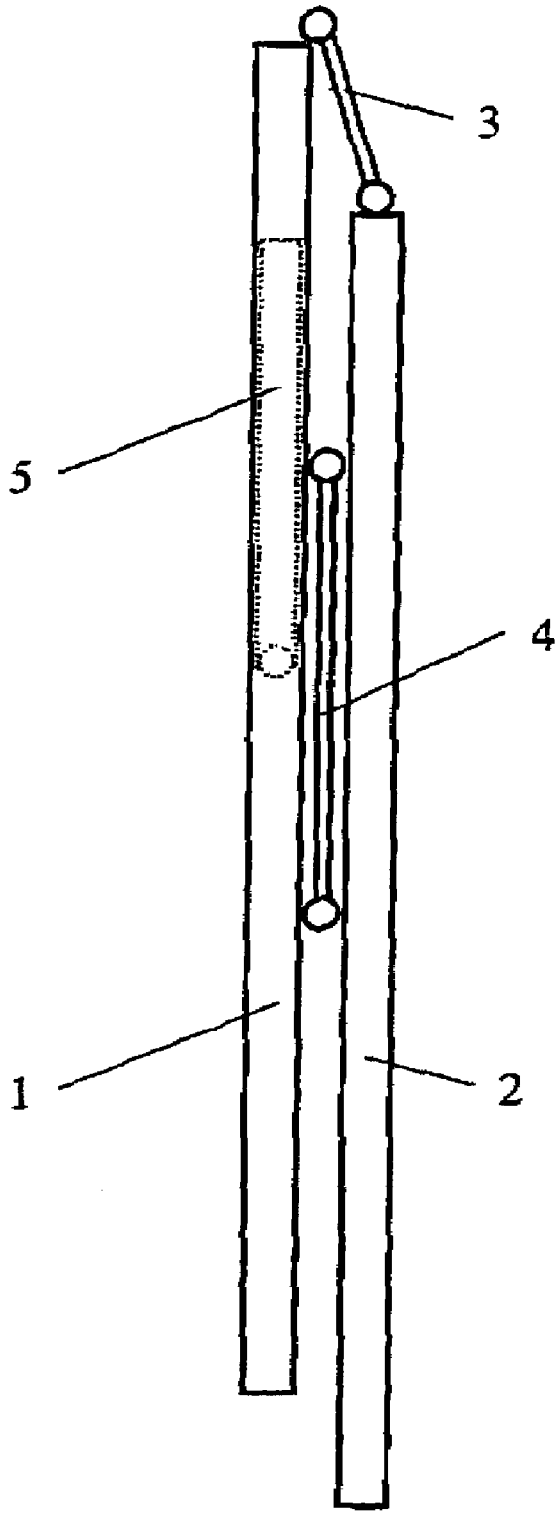
FIGS. 3 and 4 are schematic side elevational views of the ladder in a folded configuration.

As shown in schematic views FIGS. 1 to 4, the inventor sets out to achieve a platform ladder having a front climbing section at 17 degrees and a rear section at 7 degrees to the vertical with a substantial standing platform extending between the sections. The structure should also fold up into the envelope only slightly larger than the width of the stiles of the front and rear sections. A four bar mechanism was considered to achieve this aim. As shown in FIG. 1 the introduction of a hinged member (3) between the apex of the front section (1) and rear section (2) and a stay (4) hinged between these same two members away from the apex forms a four bar linkage. The top member (3) is horizontal and would provide part of an upper rail structure. The stay's position and length could be chosen to achieve the correct open and closed geometry of the ladder see FIG. 2. Further investigation revealed the linkage pivot between members (2) and (4) could be positioned at any distance along member (2). However only one solution existed for the length of the stay (4) and the position of the pivot between it and member (1) for the correct open and closed geometry. A preferred position is shown in FIG. 1.

Rear section (2) swings through an arc due to the arrangement of the four bar linkage. By connecting the rear section (2) to the free end of the platform (5) at this position constrains the mechanism to zero degrees of freedom effectively locking the ladder in an open position. Physically this can be achieved with a hook at the end of member (5) engaging a rung that spans the section member (2) providing lateral constraint on member (2) and vertical constraint on the platform member (5). This function utilizes the platform member but alternatively could be achieved with a secondary mechanism or linkage between members (1) and (2). One benefit of utilizing the platform in this way is that the ladder can only be used fully opened mitigating the problem of climbing and falling from the ladder only partially opened.

To coordinate the movement of the platform with the opening and closing of members (1) and (2) another stay (6) is introduced between the platform member (5) and the pivot between members (2) and (4). This new stay (6) (FIG. 2) reduces the total degrees of freedom to one whilst the ladder is being opened and closed. This means the user must control only one aspect of the moving linkage rather than the platform and section which would otherwise move independently. The pivot position between member (2) and stay (6) is chosen to be at the same position as the pivot connection of members (2) and (4) for practical purposes but could equally be positioned at some other point along member (2).

Figure 4:
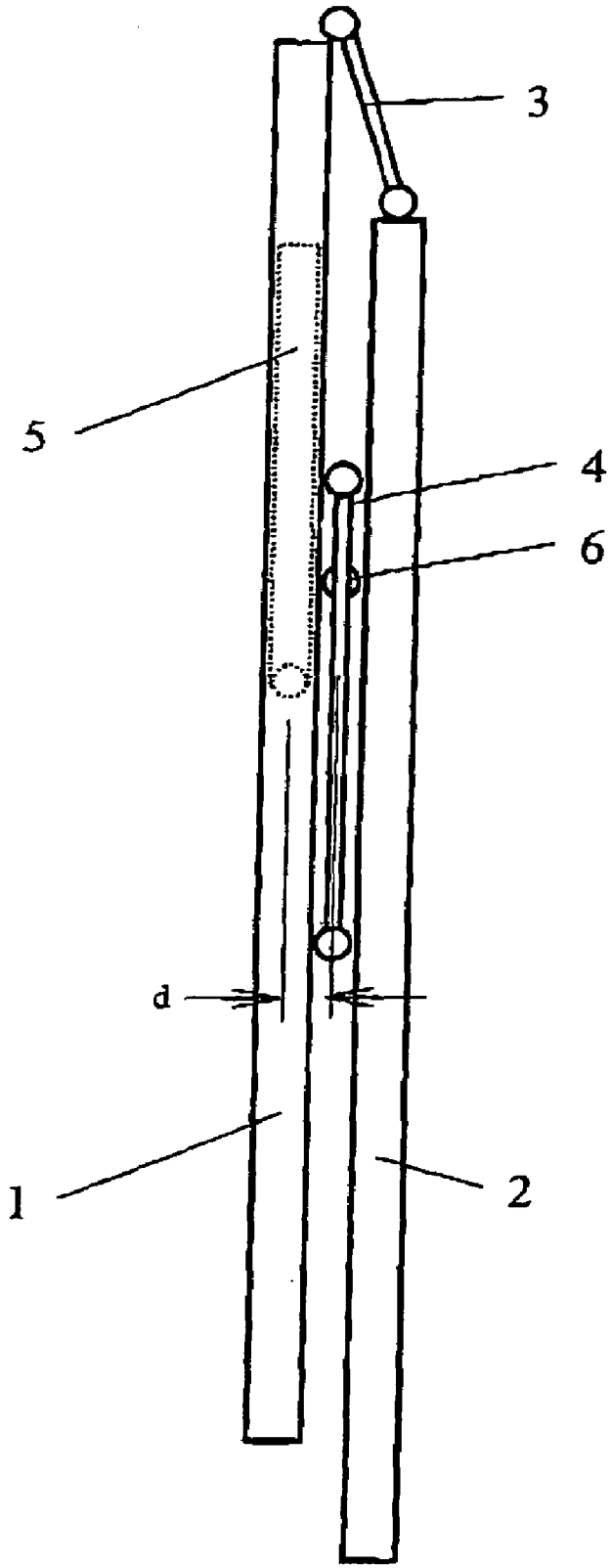
Figure 5:
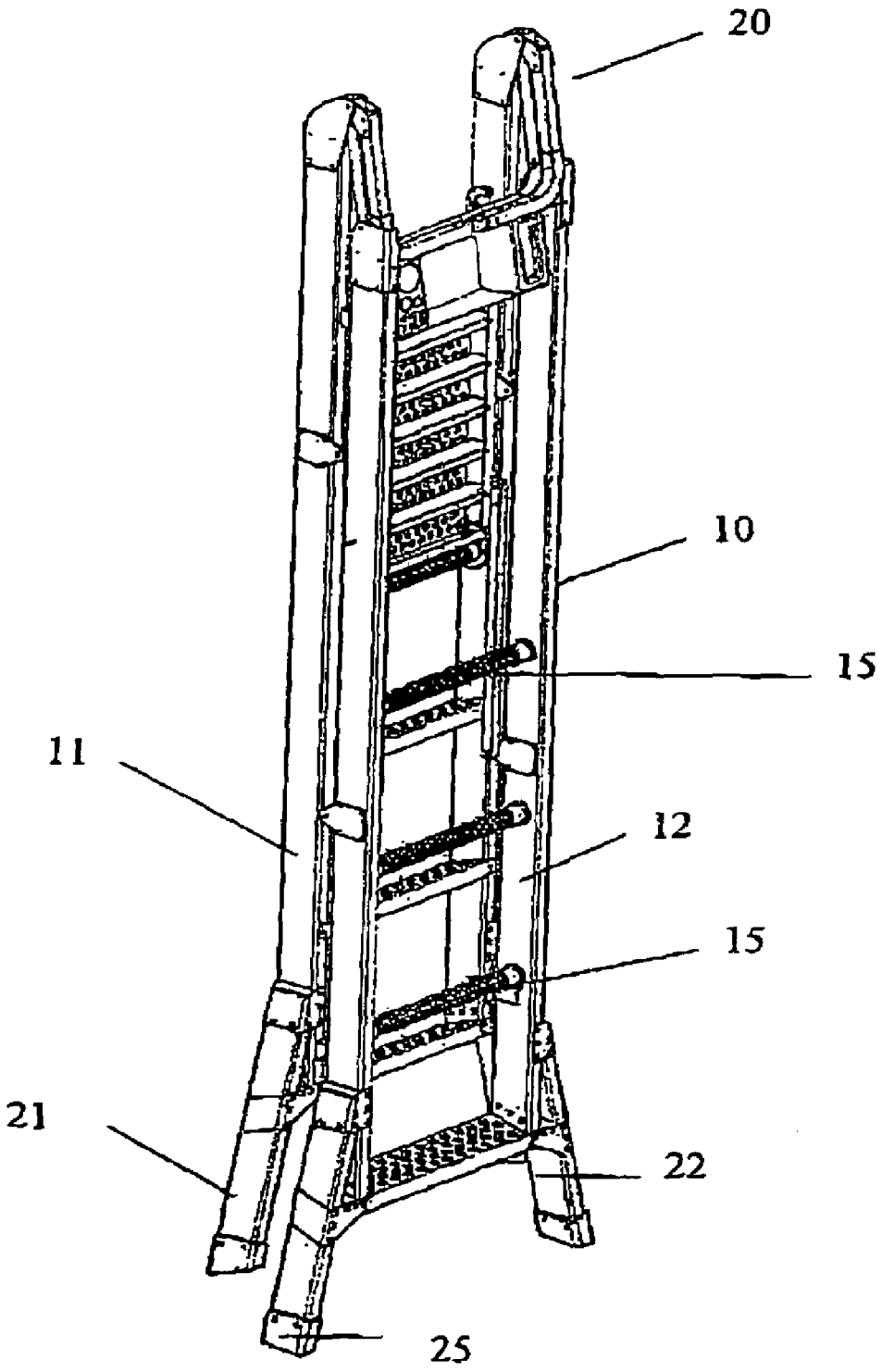
FIG. 5 is a perspective view of the ladder in a folded configuration.

The position of the pivot between platform (5) and stay (6) is then specified using the following criteria. The position below platform (5) (distance d FIG. 2) is determined such that it aligns mid distance between the two sections (1) and (2) when in the closed position (FIG. 4). There is then only one solution for the position of the pivot in the direction along the platform member (5) for any given pivot position of members (2) and (6). Another desirable feature is to add a retarding friction device to the pivot of members (5) and (6) which counteracts the platform dropping too quickly under its own weight. This ensures the ladder is in motion only when the user applies positive pressure to members (2) or (5). Alternatively this could be achieved with a spring mechanism or some such device.

Figure 6:
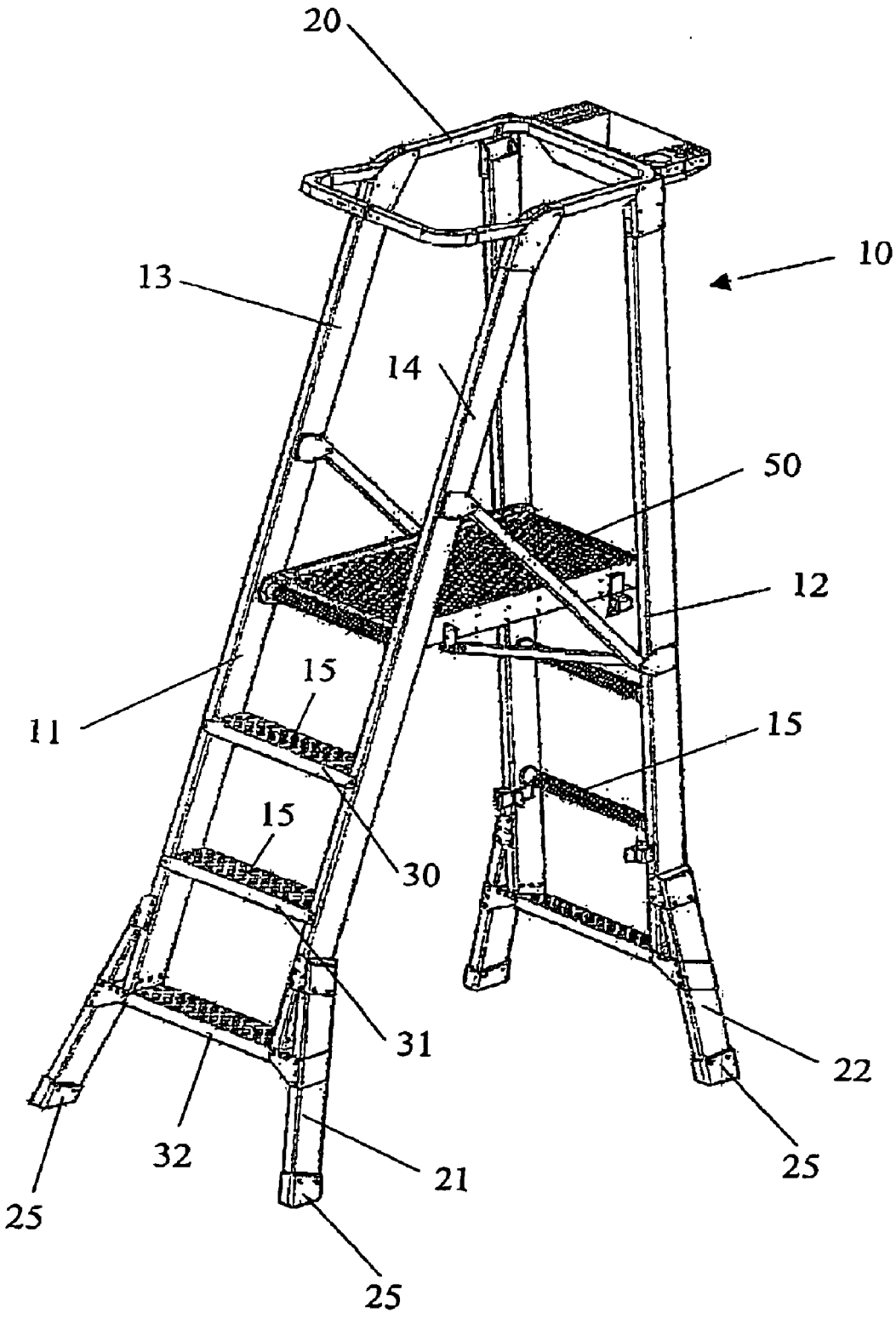
FIG. 6 is a perspective view of an actual platform ladder in an erect configuration.
Figure 7:
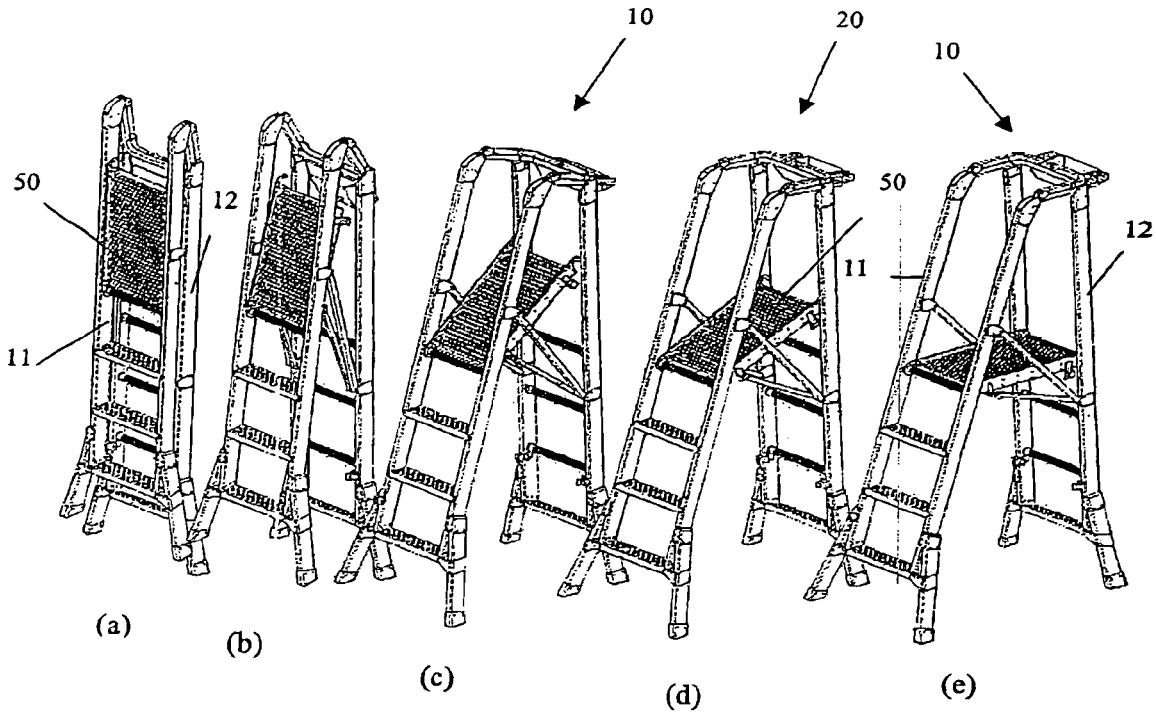
FIGS. 7*a*, 7*b*, 7*c*, 7*d* and 7*e* are progressive perspective views of the ladder from a folded configuration to an erect configuration.

Actual embodiments of the platform ladder 10 are illustrated in FIGS. 5 to 12 of the accompanying drawings. The ladder 10 comprises two elongate ladder sections 11, 12, each comprising a pair of parallel stiles 13, 14 joined by spaced rungs 15. The ladder sections 11, 12 are pivotally secured together through an upper rail 20 at the top of the ladder to define an A frame structure. The pivotal association of the ladder sections 11, 12 allows the ladder 10 to assume a folded configuration shown in FIG. 5 and then be expanded to assume the erect position shown in FIG. 6. FIG. 7 illustrates the progressive movement of the rail sections 11, 12 from the folded to the erect position.

Both rail sections 11, 12 terminate in splayed feet 21, 22 which are defined by separate sections attached to the exterior of the base of the stiles. The feet terminate in rubber or plastics insulators 25.

As shown in FIG. 6, the forward ladder section 11 constitutes the climbing section and has three spaced rungs 30, 31, 32 in the form of rectangular plates of aluminium. In the erect position a platform 50 extends across the ladder sections 11, 12 replacing what would otherwise have been the fourth rung. An upper safety rail 20 is positioned at the top of the ladder 10 so that for a user of average height the upper rail 20 is at hip height when standing on the platform 50, that is approximately 900 mm above the platform.

Figure 8:
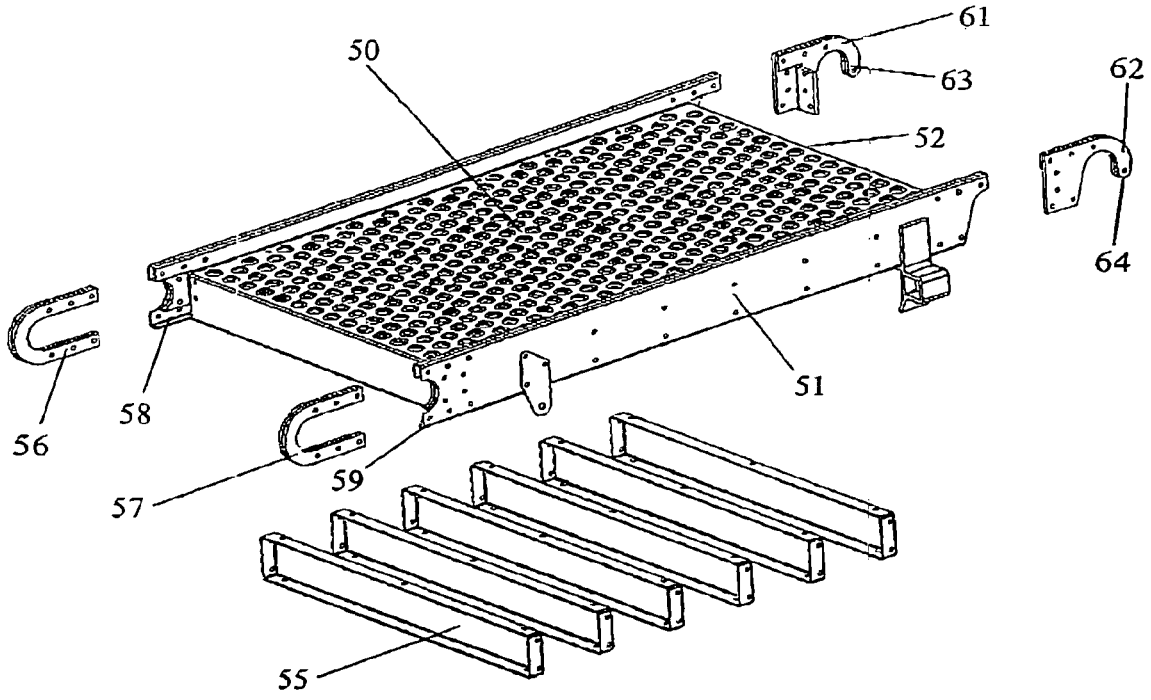
FIG. 8 is an exploded perspective view of a platform of the ladder.
Figure 9:
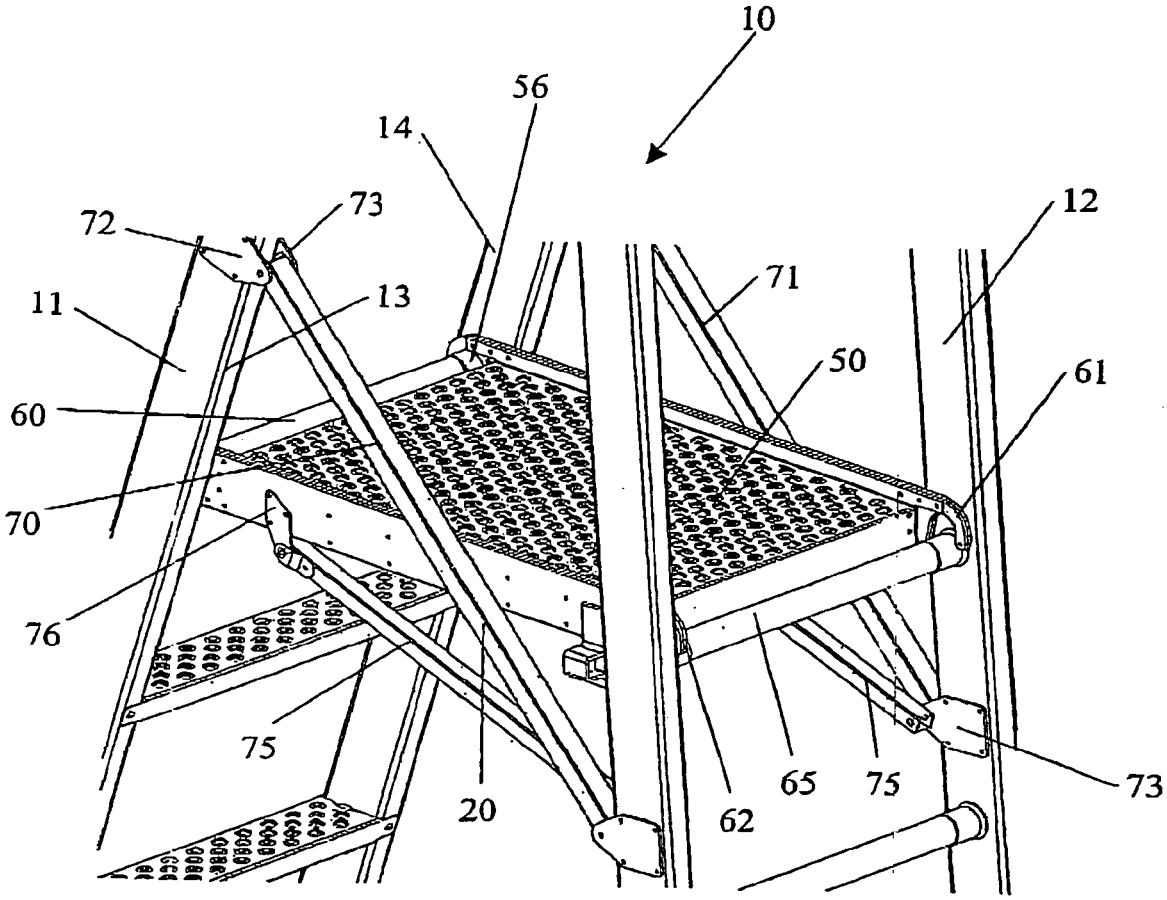
FIG. 9 is a perspective view of part of the ladder illustrating the location of the platform between ladder sections.

The platform 50 that is adapted to extend across the ladder sections 11, 12 is shown in detail in FIG. 8 and comprises a rectangular aluminium framework 51 defining a perforated standing platform 52 that is reinforced by a series of parallel reinforcing beams 55 that are located under the standing surface 52. One end of the platform is secured to the climbing section 11 by the location of U shaped brackets 56, 57 that are riveted to a U shaped recess 58, 59 on the end of the platform as shown in FIG. 9 to encase a cylindrical rung 60 extending across the stiles 13, 14 of the section. This location thus allows the platform 50 to pivot relative to the climbing section 11 about the rung 60. The opposite end of the platform is provided with a pair of hook members 61, 62 that are riveted to the ends of the platform 50 to define arcuate cutouts 63, 64 that locate on the cylindrical rung 65 on the rear section 12 of the ladder 10. The location of the platform on the rungs 60, 65 of the sections 11, 12 is shown in FIG. 9.

The climbing and rear sections 11, 12 of the ladder 10 are joined on each side by stays 70, 71 that are pivotally secured to the stiles via flanges 72, 73 that are riveted to the stiles. The inside flange 73 of the rear section 12 is also pivotally secured to a platform stay 75 that is in turn pivotally secured to the underside of the platform 50 via a flange 76 that is riveted to the platform wall. The platform stays 75 have the effect of drawing the platform 50 down from the vertical stored position shown in FIG. 2 to assume the horizontal operative position shown in FIG. 9 as the ladder sections 11, 12 are pulled apart to erect the ladder 10. The design is such that there is no need to guide or locate the platform 50 onto the rung 65 of the rear section 12, this location takes place automatically as the sections 11, 12 are pulled apart through the control of the stay 75. A friction washer (not shown) is positioned between the pivoted point of the platform stays 75 and platform 50 to retard the pivoting motion and ensure against the platform 50 dropping down hard on the rung 65.

Figure 10A:
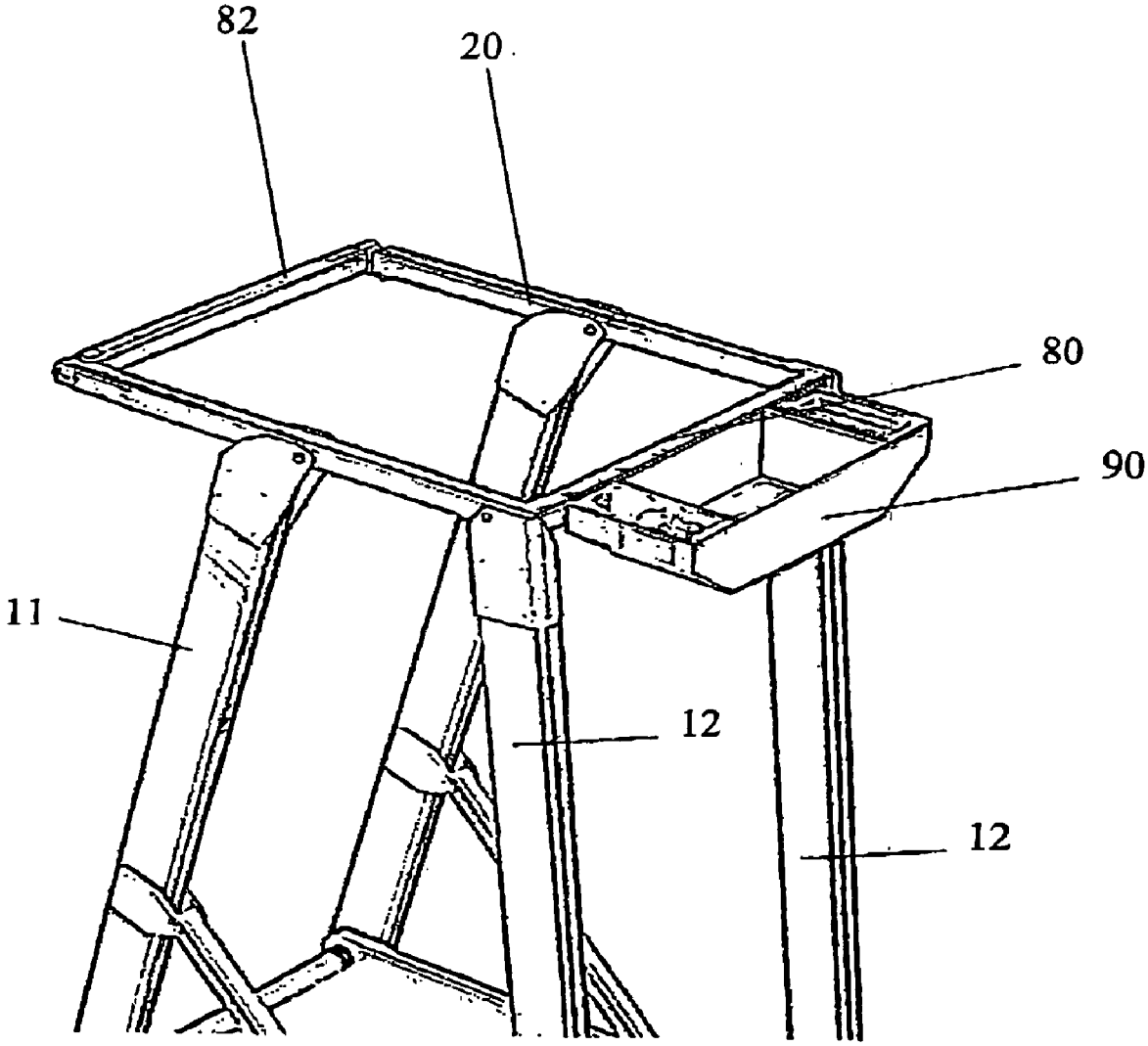
FIGS. 10*a* and 10*b* are perspective views of the top of the ladder in an expanded operative position and folded position respectively.
Figure 10B:
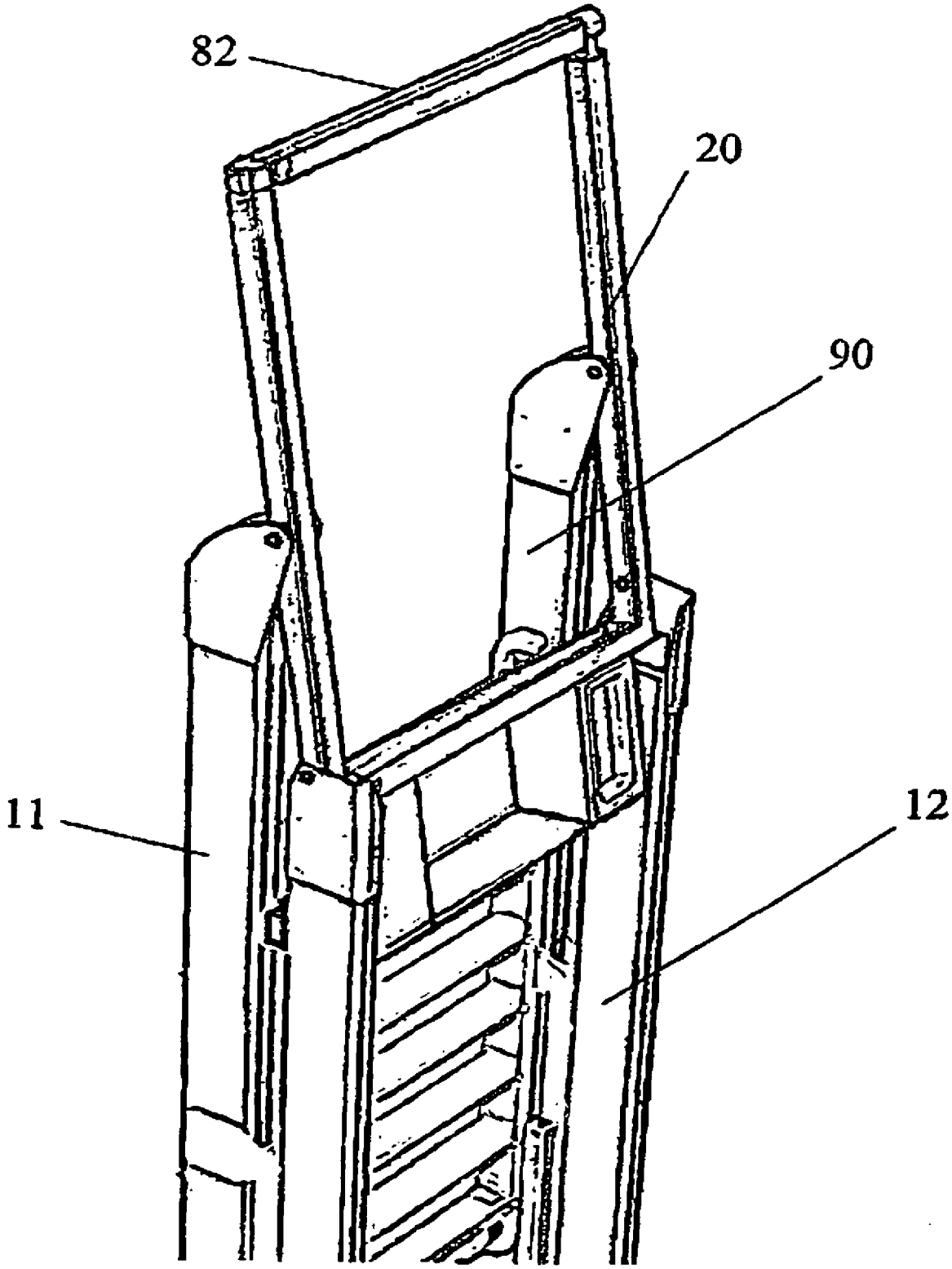
Figure 11:
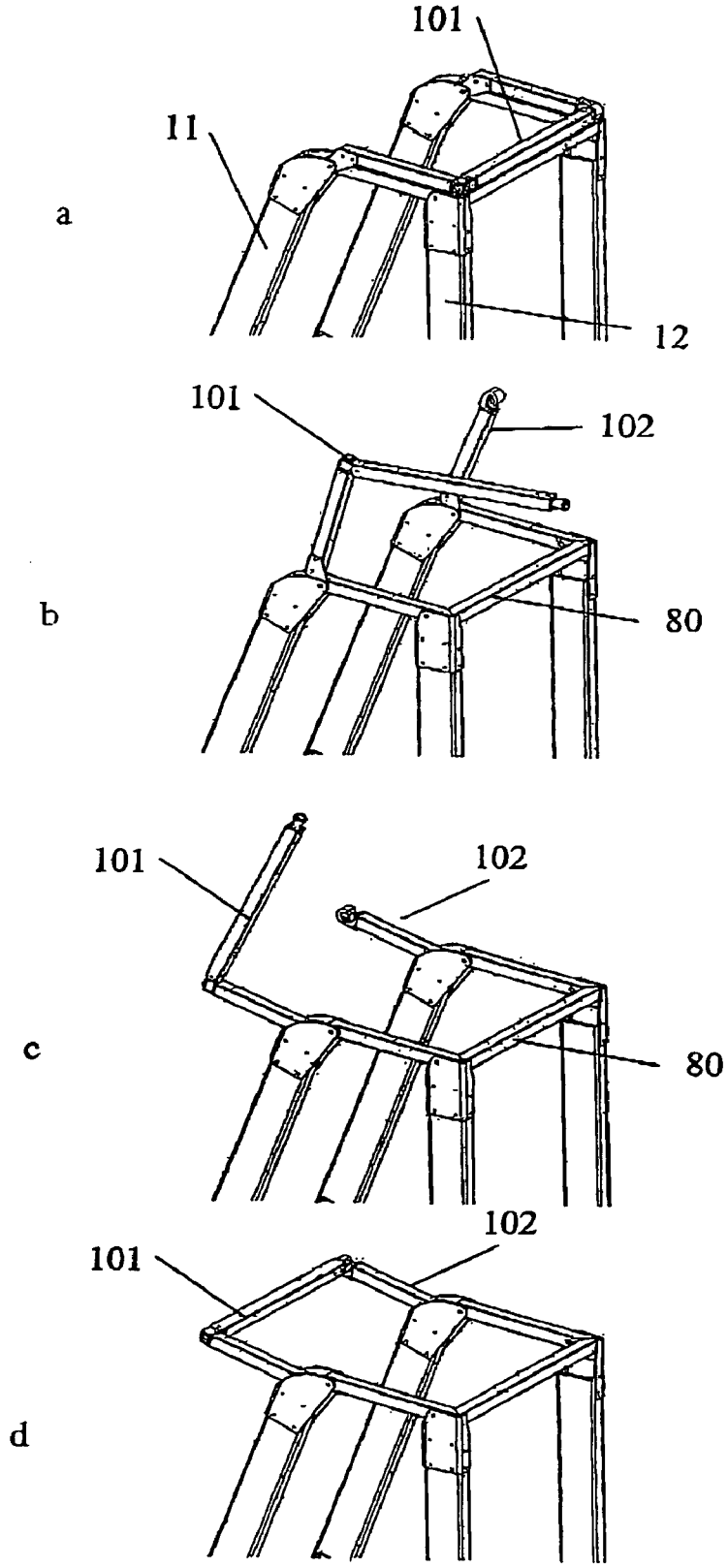
FIGS. 11*a*, 11*b*, 11*c* and 11*d* illustrate a foldable rail that forms part of the ladder.
Figure 12:
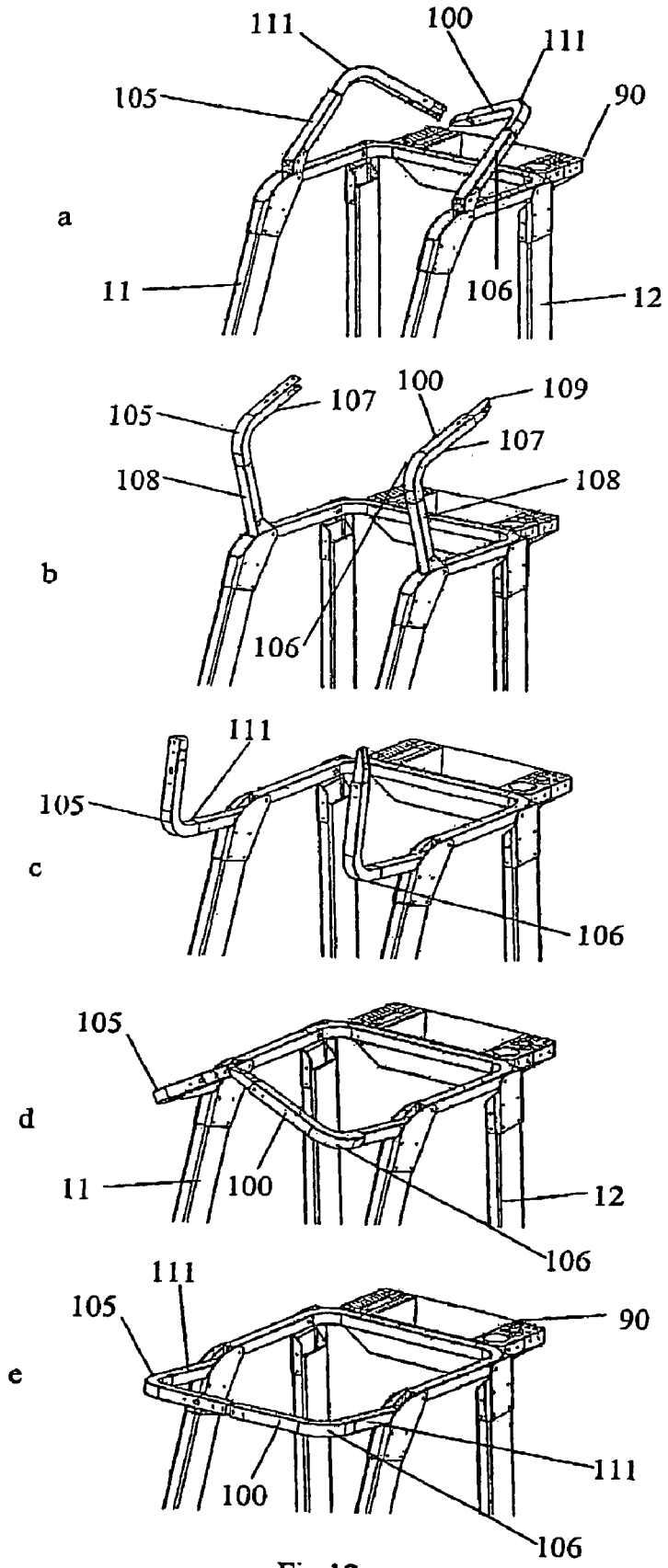
FIGS. 12*a*, 12*b*, 12*c*, 12*d* and 12*e* illustrate an alternative form of a foldable rail for use with the ladder.

As described above, the member 3 (FIG. 1) of the four point linkage essentially includes the upper rail 20 of the ladder 10 and three embodiments of this upper rail are described hereunder with reference to FIGS. 10 to 12. In all three embodiments, three square sectioned aluminium tube members are secured between flanges mounted on the ends of the stiles of the climbing and rear sections 11, 12. A cross member 80 is attached across the stiles of the rear section 12 from which can be suspended a tool tray 90. In the embodiment shown in FIGS. 10*a* and 10*b* the fourth side or cross member 82 of the rail 20 is hinged to the member and latched on the opposite side so that it can be opened to provide access. The whole rectangular rail 20 pivots about the ends of the climbing section 11. The geometry of the ladder allows an extended version of the upper rail 20 and cross member 82 to fold up within the profile defined by the outside edges of the closed ladder 10. However, it will protrude past the top end of the front section 11 of the ladder in the closed position making the overall length of the longer, see FIG. 10*b*. This configuration requires the user to open the ladder, climb up and disengage the cross member 82 to gain access to the platform area.

In the embodiments of FIGS. 11 and 12, in order to complete a four sided rail the forward section 100 must be capable of splitting such that it can pass around the body of the user and be reassembled. This function can be achieved in various ways including splitting at or near the pivot at the top of frame members and having a solid "U" section that re-latches on the other side of the ladder at or near the pivot of the frame members. The example in FIG. 11 shows the forward section comprising a right angled member 101 pivoted to the top of one stile of the forward section 11 and a second member 102 pivoted to the top of the other stile. A suitable latching device allows the locking and unlocking of the members 101 and 102. The member 101 uses a joint with two orthogonal axis and two rotational degrees of freedom allowing these members to hinge.

To operate the mechanism the user stands on the platform facing rearwards and unlatches members (101) and (102). While holding unlatched member 101 in one hand and member 102 in the other, both members are rotated to the limit of rotation provided by the flanges at the end of the stiles of member 11 (FIG. 11*c*). Member 101 is now at the front of the working area can be re-latched to member 102 fully enclosing the user. Like previous configurations this mechanism and integrated tool tray 90 attached to cross member 80 will fold within the profile of the outer edges of frame members 11, 12 but will not greatly extend the closed length of the ladder. This design is quick and easy to use, however by latching and hinging member 102 at the ends of member 101 leaves an exposed corner which could pose a hazard at eye level see FIG. 11*d*.

In the embodiment of FIG. 12 the front rail is split to two right angled members 105, 106. Each member has a forward bar 107 that is rotatable about an arm 108 which is in turn pivotally secured to the upper end of the stile of the forward section.

FIG. 12 shows the operation of the mechanism from the point where the user has opened the ladder, climbed the front section 11 and is standing on the platform 50 facing towards the rear section 12. The user lifts the bars 107 (FIG. 12*a*), and releases a latch which hold them in an aligned position. By rotating them about the arms 108 the forward ends disconnect. The arms 108 are then free to pass around the user's body and rotate until constrained by the bracket at the ends of stile. The forward bars 107 can then be re-engaged by rotating them towards each other and reinserting a spigot 109 until they are constrained to an inline position with each other by the interaction of the spigot 109 within the bar 107. The connection between bars 107 can be latched in the inline position so that unintentional separation of the members is impossible. The spigot 109 once inserted into the open end of the tube of bars 107 acts in such a way as to allow these members to only move towards the upright vertical (when folded out FIG. 12*e*) but not fall below the horizontal plane. This feature allows the connected members to bear a vertical downward load as might be applied by the users weight. Integrated into the spigot 109 is a hole which mates with a pin inside the tube of member that prevents the spigot from withdrawing while the two are aligned horizontally.

FIG. 7 shows the ladder in intermediate stages during the opening motion of the ladder. To accomplish this the user would stand facing the front section 11 with the right hand on the right hand stile of the front section. With positive pressure from the left hand (toward the ladder) to the top of the platform member 50 and drawing the front section 11 towards the user, the ladder 10 will open fully as in FIG. 7 whereupon the front legs are lowered to the ground. The rear legs remain in contact with the ground during this motion. Having the front rail folded over the rear rail allows the user to ascend the front climbing section to the platform area unimpeded. The user can then assemble the rail as illustrated in FIG. 12 providing railing protection on all four sides.

This version incorporates the side bars and cross bar into a single member (FIG. 12) which in this instance is a square hollow metal tube with two radiused bends. Forward bars 107 have radiused bends 111 in tube as above alleviating an eye hazard (See FIG. 12*e*).

The rotating pivot, inline with and at the end of arm 108 could be positioned at any point along the arm or may be incorporated in the pivoting bracket between the frame members 11, 12.

The ladder of the subject application is preferably manufactured in composite materials of fiberglass and aluminium. The elongate components such as the stiles and feet are constructed of fiberglass whilst the rungs and platform of the ladder are constructed in aluminium. The method of construction of a ladder of composite material is described in U.S. Pat. No. 5,427,198 the disclosure of which is incorporated herein by reference. Fiberglass is a particularly useful material in ladder construction due to its lightness and strength and lack of electrical conductivity.

In the illustrated embodiment the elongate fiberglass styles use aluminium capping members at the end and pop rivets are used throughout the ladder to join the various componentry. It is however understood that other fasteners can be used in the assembly of the ladder.

It is understood that the invention is applicable to platform ladders of differing dimensions so that a variety of effective heights are envisaged, usually with the platform being between 600 mm and 3600 mm above the ground.

The invention claimed is:

1. A platform ladder comprising two elongate ladder sections having feet at one end and an upper end, the upper end of each section being hinged to an upper rail, a platform pivotally secured to one ladder section below the upper end and adapted to hook against the other ladder section, and stays interconnecting each side of the ladder sections, each of the stays comprising a bracing bar hinged to each ladder section at positions that enable the ladder to assume an operative position with the ladder sections assuming an erect A shaped profile with the platform extending between the ladder sections to define a standing platform, and a folded position in which the ladder sections fold one against the other, and the platform, the upper rail and the stays fold within the plane defined by the ladder sections, the platform being coupled to the other ladder section by at least one platform stay whereby as the ladder sections are parted from the folded configuration the platform stay controls lowering of the platform until it hooks against the other ladder section when the sections are fully parted to assume the operative position, and a retarder being positioned between the platform and the platform stay to retard the relative movement and slow down the engagement of the platform with the other ladder section.

2. The platform ladder according claim 1 wherein the upper rail constitutes a safety barrier for the user of the ladder when standing on the platform and is disposed about 900 mm above the platform.

3. The platform ladder according to claim 1 wherein each ladder section comprises elongate fiberglass stiles joined by spaced aluminium rungs.

4. A platform ladder comprising two elongate ladder sections having feet at one end and an upper end, the upper end of each section being hinged to an upper rail, a platform pivotally secured to one ladder section below the upper end and adapted to hook against the other ladder section, and stays interconnecting each side of the ladder sections, each of the stays comprising a bracing bar hinged to each ladder section at positions that enable the ladder to assume an operative position with the ladder sections assuming an erect A shaped profile with the platform extending between the ladder sections to define a standing platform, and a folded position in which the ladder sections fold one against the other, and the platform, the upper rail and the stays fold within the plane defined by the ladder sections, the upper railing including interfitting sections that form a closed loop to surround the user.

5. The platform ladder according claim 4 wherein the upper rail constitutes a safety barrier for the user of the ladder when standing on the platform and is disposed about 900 mm above the platform.

6. The platform ladder according to claim 4 wherein each ladder section comprises elongate fiberglass stiles joined by spaced aluminium rungs.

7. The ladder according to claim 4 wherein the upper rail has lateral sides extending between the ladder sections and a cross section extending across the rear ladder section, a U shaped arm being pivotally secured across the lateral sides of the front ladder section, the arm being in two pieces that can be latched together to close the rail or be opened and pivoted clear of the front section to provide access.

* * * * *